United States Patent [19]

Agosta

[11] 4,437,702

[45] Mar. 20, 1984

[54] ADJUSTABLE PATIENT CORRECTIVE SUPPORT APPARATUS

[76] Inventor: A. Richard Agosta, 45-49 218th St., Bayside, N.Y. 11361

[21] Appl. No.: 251,280

[22] Filed: Apr. 6, 1981

[51] Int. Cl.[3] ..... A47C 3/00

[52] U.S. Cl. ..... 297/284; 5/248; 5/447

[58] Field of Search ..... 297/284; 5/447, 256, 5/258, 248, 230; 267/89

[56] References Cited

U.S. PATENT DOCUMENTS

| | | | |
|---|---|---|---|
| 38,551 | 5/1863 | Blythe | 5/230 |
| 2,359,318 | 10/1944 | Lay . | |
| 2,542,366 | 2/1951 | Scott . | |
| 2,549,902 | 4/1951 | Hibbard . | |
| 2,595,072 | 4/1952 | Gottschalk | 5/248 |
| 2,673,357 | 3/1954 | Brandwein | 5/447 |
| 2,742,957 | 4/1956 | Young | 5/256 |
| 2,991,124 | 7/1961 | Schwarz . | |
| 3,058,778 | 10/1962 | Campbell | 5/447 |
| 3,081,129 | 3/1963 | Ridder | 297/284 |
| 3,106,423 | 10/1963 | Schwarz . | |
| 3,121,592 | 2/1964 | Anderson . | |
| 3,288,525 | 11/1966 | Cerf . | |
| 3,321,241 | 5/1967 | Froelich | 297/284 |
| 3,464,754 | 1/1967 | Gottfried . | |
| 3,596,990 | 8/1971 | Gottfried . | |
| 3,879,776 | 4/1975 | Solen | 5/447 |
| 3,990,742 | 11/1976 | Glass . | |

*Primary Examiner*—Francis K. Zugel

*Attorney, Agent, or Firm*—Albert F. Kronman

[57] ABSTRACT

A chair or similar article of furniture is disclosed in which a plurality of individually adjustable spring members are incorporated into the chair structure so that specific areas of the chair may be adjusted to conform to or correctively support portions of the body of the person placed in the chair.

7 Claims, 8 Drawing Figures

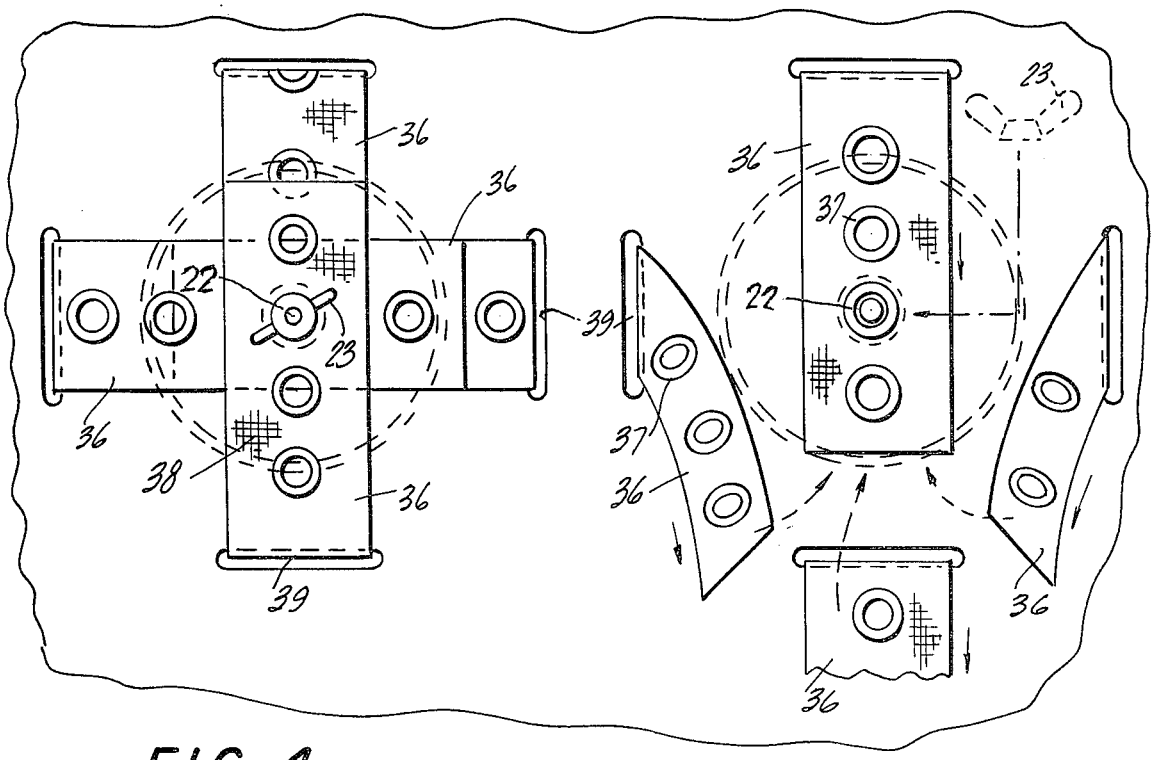
FIG. 4
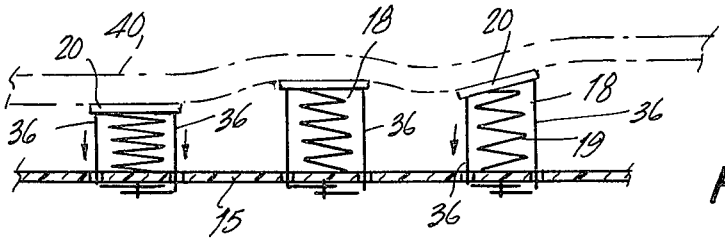
FIG. 5
FIG. 7
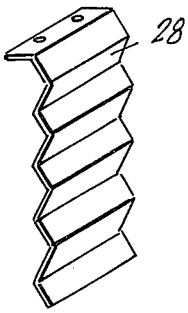
FIG. 6
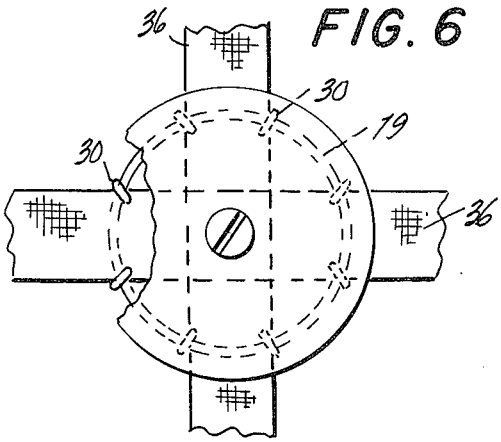
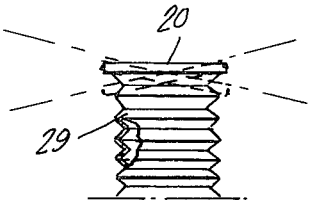
FIG. 8

ADJUSTABLE PATIENT CORRECTIVE SUPPORT APPARATUS

BACKGROUND OF THE INVENTION

Chairs having adjustable areas for orthopedic purposes are well known in the art. Such chairs are customarily built to the contour of a person in order to increase the comfort of the user. It is well known to provide adjustable means for lumbar support to relieve back fatigue.

In the treatment of certain patients it becomes important to support certain portions of the body due to physical malformations and, particularly in the case of growing children to be able to correct their posture from time to time over a long period of years to achieve better bone conformation. Certain patients are unable to remain in a sitting position unless support is supplied at certain areas on the body so that they can remain comfortably erect. Proper sitting position is often essential while feeding such patients.

Accordingly, it is an object of the present invention to provide a corrective and therapeutic chair for hospital and invalid use. Another object of the present invention is to provide a chair in which individual areas may be adjusted throughout a large number of angles and curvatures as desired by a therapist.

A further object of the present invention is to provide a chair in which precise adjustments of the supporting surfaces are possible after the patient has been placed upon the chair.

Still another object of the present invention is to provide a chair which may be controlled without need for elaborate mechanisms and which is safe to use in a hospital or home environment.

SUMMARY

Chairs made in accordance with the present invention consist of a rigid back portion and a resilient or upholstered person support structure. A plurality of spring members are carried by the rigid portion and extend into the space between the upholstered layer. Adjusting means extend through rigid portions of the chair and are available on the outside of the rigid portion for adjustment of each of the spring members in the chair. A support disc or pad is carried by the spring means so as to bear against the inside surface of the upholstered portion of the chair. The angular disposition of the discs or pads is controlled by flexible members secured at one end to the spring members and controllable from the outside of the rigid member where they may also be secured.

DESCRIPTION OF THE DRAWINGS

In the accompanying drawings forming part hereof;

FIG. 4 is an elevational view taken on line 4—4 in FIG. 3.

FIG. 5 is a somewhat diagrammatic view showing the manner in which the contour of the chair can be adjusted.

FIG. 6 is a fragmentary view on an enlarged scale showing the support pad portion of the spring adjusting means.

FIG. 7 is an isometric view of a wave spring useful in the present invention.

FIG. 8 is an elevational view partly broken away of a bellows spring useful in the present invention.

GENERAL DESCRIPTION

In the present invention there is described and shown an adjustable chair for use in hospitals, sick rooms and the like. It is to be understood, however, that the adjustable supporting features of the present invention may also be used in hospital beds, chaise lounges, wheel chairs, and other articles of furniture without departing from the spirit of the invention. While there is illustrated adjustable supports for the back and seat of the chair, it will be obvious to those skilled in the art that the same mechanisms can be employed for the arms of a chair or other articles of furniture.

Figure 2:
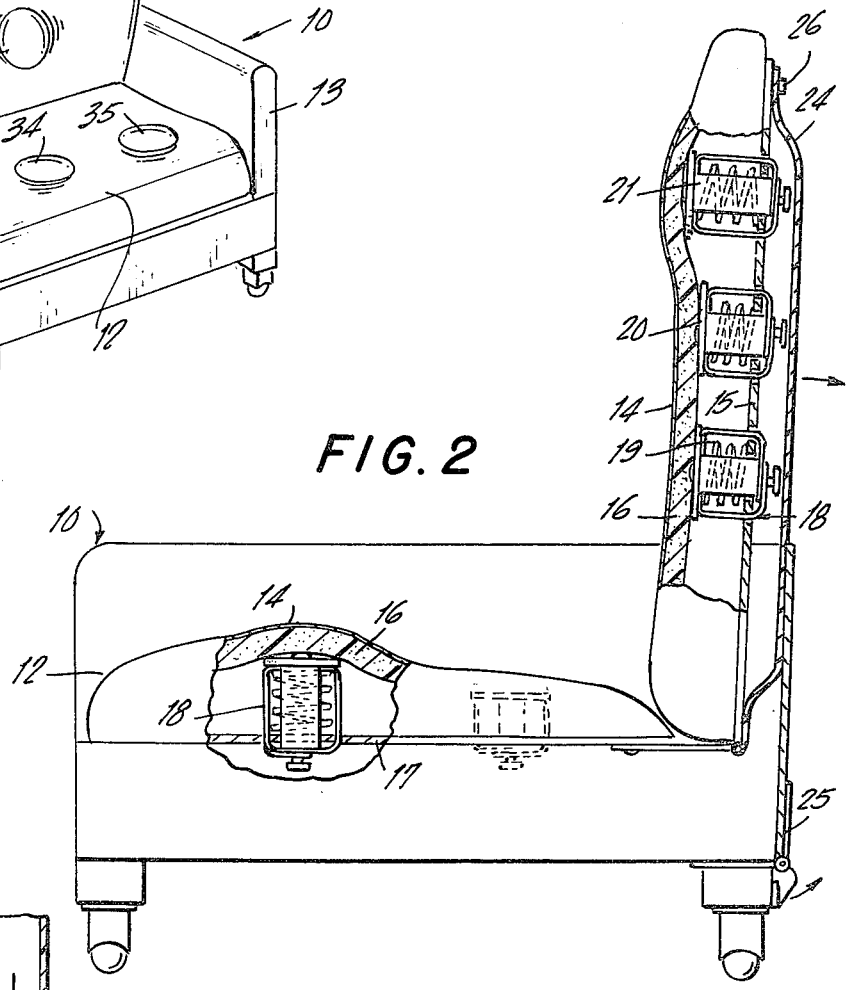
FIG. 2 is a view in side elevation (somewhat enlarged) partially cut away and in section showing the adjusting mechanism.
Figure 3:
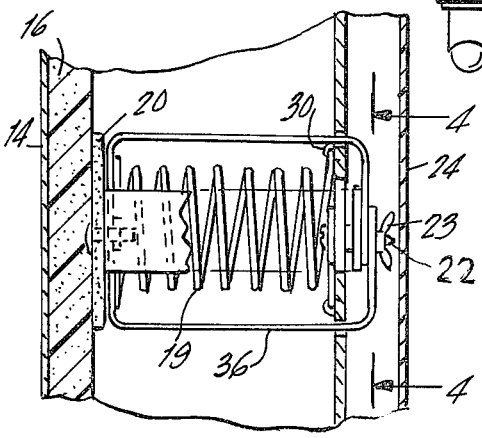
FIG. 3 is a fragmentary cross section of a portion of a chair illustrating the spring adjusting mechanism.

Referring to the drawings, 10 indicates a chair in accordance with the present invention having a back 11 a seat 12 and arms 13. The chair is covered by some suitable upholstery material such as a fabric or plastic 14. The specific design of the chair may vary depending upon the nature of its intended use or for decorative reasons. As shown in FIG. 2 the back of the chair is provided with a rigid panel 15 which is spaced from the upholstering material 16 underlying the fabric 14. The rigid panel 15 is secured at its top and bottom to chair frame members (not shown).

An examination of the seat portion 12 shown in the cut away view in FIG. 2 will disclose that it to is provided with a rigid horizontal panel 17 spaced from the upholstered fabric of the seat 12. The rigid panels 15, 17, serve to support a plurality of adjusting assemblies 18 consisting of a spring member 19 secured at one end to the rigid panel 15 or 17, a disc or pad 20 on the free end of the spring, flexible ties 21, and an anchoring bolt 22 and wing nut 23.

It is within the purview of the present invention to make the rigid panels 15, 17 of a suitable transparent plastic such as nylon or methyl methacrylate, for a hereinafter more fully described purpose. In addition, and for the purpose of accidental or unauthorized movement of the adjusted chair some form of shield plate 24 may be secured over the back of the chair by means of a hinge 25 and lock 26.

Figure 1:
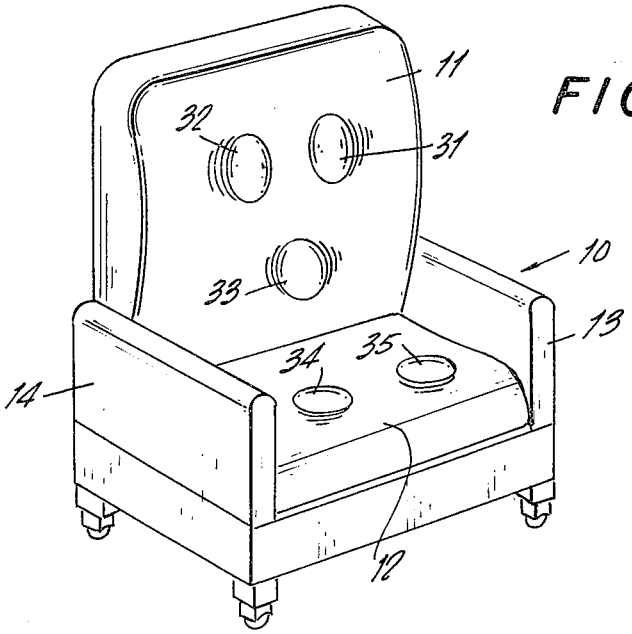
FIG. 1 is a somewhat isometric view of a chair made in accordance with the present invention.

The spring member 19 which may be a coil spring 27 shown in FIGS. 2–6 or wave spring 28, best shown in FIG. 7 as well as a bellows 29 is secured at one end to the rigid panel 15 or 17 by means of staples 30 or any other convenient fastener. In the case of a wave spring it is to be understood that two or more wave spring units 28 would be employed in opposed relationship to provide the spring function. The free end of the spring member 19 is provided with a disc or pad 20 to protect the person in the chair from contact with the end of the spring. The disc 20 also prevents the springs from wearing through the upholstering material. It will be apparent from an examination of FIGS. 1, 2 and 5 that a plurality of spring members will be employed across rigid panels 15, 17 in spaced relationship from each other so that complete adjustability over the entire back or seat surface is available to the therapist or user of the adjustable chair. Thus, for example, in the showing of FIG. 1, if the patient needs lateral support in order to enable him to sit erect two of the spring members will be advanced to provide bulges indicated at 31, 32, which will bear gently against the person sides. If a lower back or lumbar support is desired an additional bulge 33 will be formed by advancing the spring member at that juncture in the manner hereinafter more fully described. Should there be a need to raise the patient's legs slightly in order to maintain the body against the back of the chair the bulges 34, 35 shown in FIG. 1 can be produced for this purpose. The variation and location of adjustments capable with the present invention are too numerous to be calculated at this point.

Adjustment of the chair may be accomplished with or without the patient sitting in the chair. Thus, for example, the patient might be measured and the adjustments made from measurements. Alternately, the patient may be held in a seated position so that the desired contact with the chair is achieved. By removing the shield plate 24 a therapist could then examine the rear of the upholstered material and adjust the upholstery adjusting assemblies 18 to the impression made by the patient seated in the chair. Thus, for example, a slight amount of pressure might be applied to the back of the patient at a desired angle to correct a spinal curvature or some other physical malformation. The adjusting assemblies can be used to apply lateral support for the torso or legs of the patient. As the patient grows or improves in posture or gains strength through normal therapy it is possible to make changes and adjustments in the adjusting assemblies without having to rebuild or reupholster the chair. It will also be apparent that the chair has universal application in that the same chair may be used for a wide variety of disabilities.

Each of the spring members 19 is provided with flexible adjusting straps 36 which are secured at one end to the discs 20 by means of grommets 37 or some similar securing device. The straps 36 may be made of woven fibers 38 as shown in FIG. 4 or of flexible plastic as desired. A series of spaced grommets 37 is provided for the length of the straps 36 as best shown in FIG. 4. It is preferred to have at least one pair of straps 36 in opposed relationship for each spring member. The free ends of each of the straps 36 are pulled through slots 39 in the rigid panels 15, 17 as shown at the right of FIG. 4.

It will be apparent from an examination of FIG. 5 that as the straps 36 are pulled through the rigid panels 15, 17 the spring members 18 will be compressed. As the spring members are compressed the discs 20 draw the upholstery toward the rigid panels 15, 17 to produce a depression indicated at 40 in FIG. 4. It is to be understood that the discs 20 are adhesively secured to the upholstering material 16. Alternately, the disc themselves may be made of a resilient material and the chair covered in clear plastic rather than the fabric 14. In this manner it will be easier to observe the position and attitude of the patient.

The middle spring adjusting assembly 18 shown in FIG. 5 represents an intermediate position of the chair back or seat upholstering and the adjusting assembly 18 shown at the right in FIG. 5 illustrates a position of the spring member 19 in which the disc 20 is angularly disposed. The angular disposition of the pad is achieved by pulling one or more of the straps 36 through the slot 39 more than the other straps in the particular adjusting assembly 18. A very large number of disc positions can thus be arranged to match any contour of the body as required. When the straps 36 have been pulled to their desired location the nearest grommet 37 is slipped over an anchoring bolt 22 which is secured to and extends out of the rigid panels 15, 17 at the base of each spring member. When all of the straps have been so anchored, a wing nut or any other suitable nut 23 is threaded upon the end of the bolt to insure the permanence of the adjusted position. It will be observed that the adjusting assemblies are of such simple construction that they may be changed, adjusted and arranged without the need of special tools and by persons with little mechanical aptitude.

The description of the manner in which the chair is given the desired contour applies whether the adjusting assemblies 18 are located in the back, seat or arms of the chair. It is also possible to have the back of the chair high enough to provide support for the person's head.

From the foregoing it will be observed that there has been provided an adjustable chair or other article of furniture which is capable of a wide variety of adjustments to meet the needs of patients who present physcial disabilities requiring bodily support. Chairs or articles of furniture made in accordance with the present invention can be uniform in manufacture thereby greatly reducing their cost without limiting their eventual application for therapy. The articles of furniture are simple in construction, easy to adjust and adaptable for use with patients who may have periods of violent activity while being seated or reclining on the furniture.

Having thus fully described the invention what is desired to be claimed and secured by Letters Patent is:

1. An adjustable, patient corrective, support comprising:

(a) a resilient body receiving member;

(b) at least one rigid supporting panel spaced from said body receiving member;

(c) a plurality of spaced spring members secured at one end to the rigid panel and extending into the space between the rigid supporting panel and the body receiving member;

(d) at least one pair of opposed spaced elongated flexible straps extending over and coupled to the free ends of the spring members;

(e) slots in the rigid panel adjacent each of the spring members to receive the free ends of the flexible straps therethrough; and (f) fastening means, carried by the rigid panel to secure the four ends of said at least one pair of straps in any desired position along their length and individually dispose the free ends of the springs at any one of a wide number of angles with respect to the plane of the rigid panel.

2. An article according to claim 1 in which a sheet of upholstering material is coupled to the free ends of the spring members.

3. An article according to claim 1 in which the rigid supporting panel is made of a transparent material.

4. An article according to claim 1 in which the flexible straps are coupled to the free ends of the spring members on opposite sides and to the extending parallel longitudinal axis of each of the spring members.

5. An article according to claim 1 in which the flexible straps are secured between a pad and the free end of the spring members.

6. An article according to claim 1 in which the rigid supporting panel comprises an upright torso receiving member and a substantially horizontal seat portion.

7. An article according to claim 1 in which the elongated flexible straps are provided with a series of spaced grommets and the fastening means comprises a bolt extending outwardly from the rigid supporting panel to receive one or more of the strap grommets.

* * * * *